US009878329B2

(12) United States Patent
Iqbal et al.

(10) Patent No.: US 9,878,329 B2
(45) Date of Patent: Jan. 30, 2018

(54) SELF-CONTAINED SLIDE RECEPTACLE FOR PATIENT SPECIMENS

(71) Applicant: SYFR, INC., Danville, CA (US)

(72) Inventors: Shazi S Iqbal, Danville, CA (US); Michael Mayo, Austin, TX (US); Paul Parks, Austin, TX (US); Alexander Greis, Austin, TX (US)

(73) Assignee: SYFR, Inc., Danville, CA (US)

( * ) Notice: Subject to any disclaimer, the term of this patent is extended or adjusted under 35 U.S.C. 154(b) by 0 days.

(21) Appl. No.: 14/666,301

(22) Filed: Mar. 23, 2015

(65) Prior Publication Data

US 2016/0279640 A1 Sep. 29, 2016

(51) Int. Cl.
*B01L 9/00* (2006.01)
*B01L 3/00* (2006.01)

(52) U.S. Cl.
CPC ..... *B01L 9/527* (2013.01); *B01L 3/502715* (2013.01); *B01L 3/502746* (2013.01); *B01L 3/502738* (2013.01); *B01L 2200/025* (2013.01); *B01L 2200/027* (2013.01); *B01L 2300/0858* (2013.01); *B01L 2300/0867* (2013.01); *B01L 2400/0605* (2013.01); *B01L 2400/086* (2013.01)

(58) Field of Classification Search
CPC ..... B01L 9/527; B01L 3/502746; B01L 3/502715; B01L 3/502738; B01L 2400/086; B01L 2200/025; B01L 2300/0867; B01L 2300/0858; B01L 2200/027; B01L 2400/0605
See application file for complete search history.

(56) References Cited

U.S. PATENT DOCUMENTS

| | | | | |
|---|---|---|---|---|
| 8,675,453 | B2 | 3/2014 | Iqbal | |
| 8,975,039 | B2 | 3/2015 | Iqbal | |
| 9,295,988 | B2 * | 3/2016 | Henry | B01L 3/5027 |
| 2003/0059349 | A1 | 3/2003 | Howe | |
| 2003/0129756 | A1 | 7/2003 | Thorne, IV et al. | |
| 2006/0215155 | A1 | 9/2006 | Weber | |
| 2014/0065656 | A1 * | 3/2014 | Baysal | G01N 1/31 435/29 |

FOREIGN PATENT DOCUMENTS

| | | | |
|---|---|---|---|
| WO | 03052428 | A1 | 9/2006 |
| WO | 2013106458 | A2 | 7/2013 |

* cited by examiner

*Primary Examiner* — Sally A Merkling
(74) *Attorney, Agent, or Firm* — Mark P Kahler

(57) ABSTRACT

A self-contained sample processing cartridge, is disclosed. The sample processing cartridge includes a first member that includes a receiver to receive a sample specimen slide. The cartridge may also include a second member that closes on the first member to form a chamber inside the cartridge. The sample specimen slide forms a surface of the chamber. Placing the slide in the cartridge effectively completes the chamber of the cartridge. In one embodiment, the receiver of the first member includes an open region adjacent which the specimen slide is received. The second member includes a plurality of fluid inputs and at least one fluid output. The plurality of fluid inputs couples to the chamber by a plurality of channels respectively therebetween. In one embodiment, at least one of the plurality of channels may include a reagent reservoir and at least one of the plurality of channels includes a dissolvable blocking reservoir.

11 Claims, 7 Drawing Sheets

100

100'

SELF-CONTAINED SLIDE RECEPTACLE FOR PATIENT SPECIMENS

BACKGROUND

The disclosures herein relate generally to patient specimen testing, and more specifically to apparatus for more efficiently testing patient specimens. The testing of patient specimens requires a great deal of precision and accuracy, which necessarily consume a large amount of time in conventional patient specimen testing protocols. It is desirable to maintain this precision and accuracy while processing patient specimen more efficiently.

BRIEF SUMMARY

In one embodiment, a self-contained sample processing cartridge, is disclosed. The sample processing cartridge includes a first cartridge portion including a receiver that receives a specimen slide. The sample processing cartridge further includes a second cartridge portion that closes on the first cartridge portion to form a chamber interior to the cartridge, wherein the specimen slide forms a surface of the chamber. In one embodiment, the specimen slide forms one wall of the chamber to effectively complete the chamber. In one embodiment, the receiver of the first cartridge portion includes an open region adjacent which the specimen slide is received. In one embodiment, the second cartridge portion includes a plurality of fluid inputs and at least one fluid output. The plurality of fluid inputs couples to the chamber by a plurality of channels respectively therebetween. In one embodiment, at least one of the plurality of channels includes a reagent reservoir. In one embodiment, at least one of the plurality of channels includes a blocking reservoir.

BRIEF DESCRIPTION OF THE DRAWINGS

The appended drawings illustrate only exemplary embodiments of the invention and therefore do not limit its scope because the inventive concepts lend themselves to other equally effective embodiments.

DETAILED DESCRIPTION

In one embodiment, a self-contained sample processing cartridge is disclosed. The cartridge includes a lower member with a slide receiver that receives a slide with a sample thereon. The cartridge also includes an upper member configured such that when the upper member is closed upon the lower member, a chamber is formed between the upper member and the lower member. The slide being situated within the sample processing cartridge effectively completes the cartridge chamber and provides one of the major surfaces of the cartridge chamber. The sample processing cartridge includes multiple fluid inputs and at least one fluid output. In one embodiment, the upper member of the cartridge includes multiple fluid channels. One or more of the fluid channels include reservoirs, such as reagent reservoirs and fluid blocking reservoirs, as explained in more detail below. In one embodiment, the user is provided with a complete cartridge assembly except for the glass slide on which the specimen is placed. The reservoirs in the channels of the cartridge assembly are preloaded with reagents required for the particular testing protocol corresponding to the sample on the glass slide of the cartridge. Such reagents may include antibodies, DNA/RNA oligonucleotides and enzymes. When the user places the glass slide in the lower member and closes the upper member, the glass slide forms one of the interior walls of the sealed chamber.

Figure 1A:
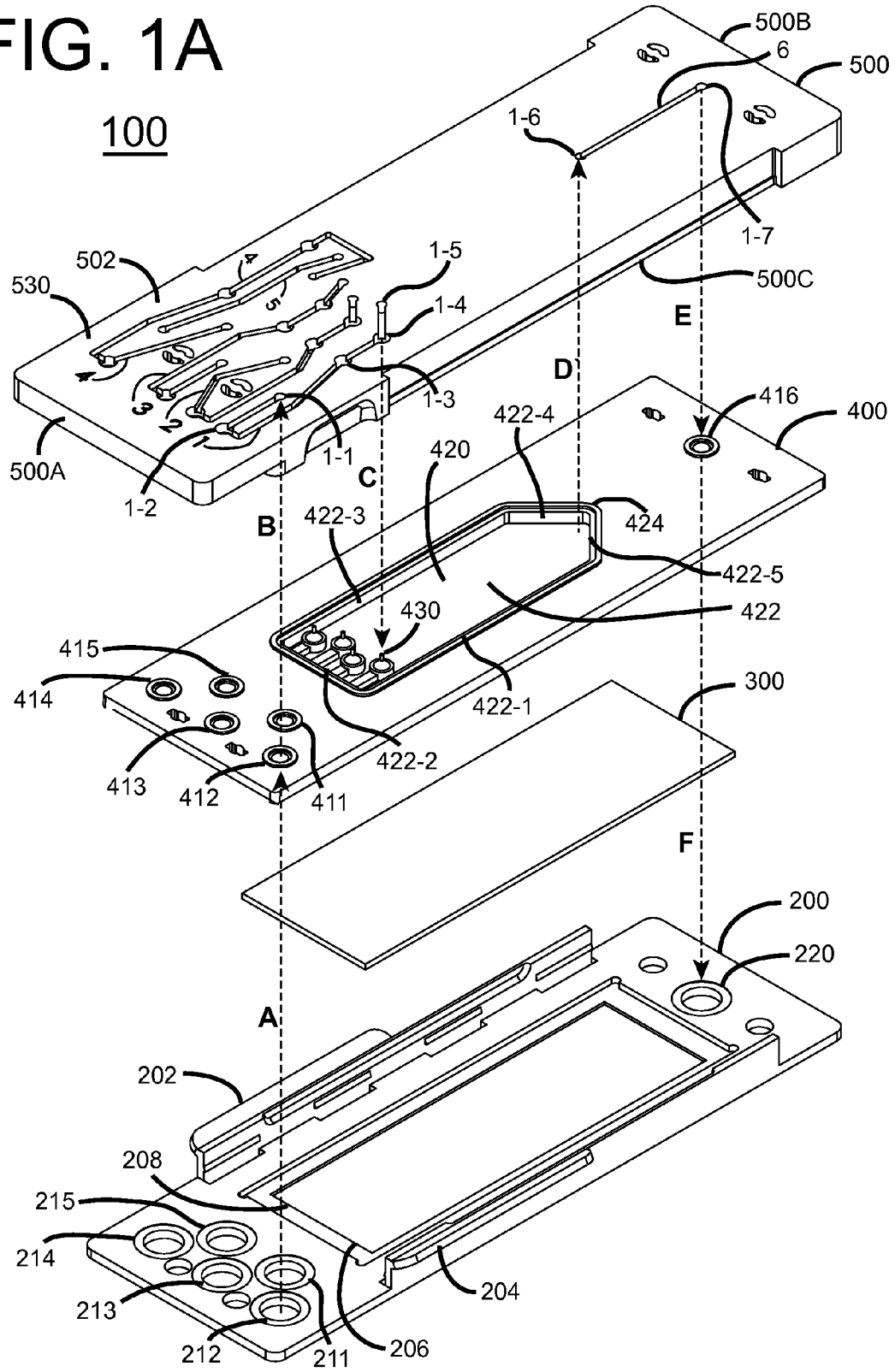
FIG. 1A is an exploded view of one embodiment of the disclosed sample processing cartridge

FIG. 1A is an exploded view of one embodiment of the disclosed sample processing cartridge 100. Cartridge 100 includes lower member 200, glass slide 300, gasket 400 and upper member 500. Lower member 200 may be fabricated from polycarbonate, polypropylene or other plastic material. Opposed sides of lower member 200 include wing-like tabs 202 and 204 that facilitate the user grasping the cartridge 100 for ease of opening the cartridge. Lower member 200 includes an aperture, i.e. an open region, 206 adjacent a recessed retaining ledge 208. Recessed retaining ledge 208 acts as a receiver that receives and retains glass slide 300 and its sample, i.e. specimen, when the user places glass slide 300 in lower member 200. Glass slide 300 forms one of the sides of the cartridge chamber that is discussed below.

Lower member 200 includes fluid inputs 211, 212, 213, 214 and 215 to which different fluids such as chemical reagents may be supplied when cartridge 100 is fully assembled with glass slide 300 therein. Lower member 200 also includes a fluid output 220 through which all fluids from the chamber within cartridge 100 exit when testing such as staining of the sample (not shown) on the slide 300 within the cartridge is complete.

Cartridge 100 includes gasket 400 that may be fabricated from rubber or similar elastomeric material that provides sealing properties. Gasket 400 includes gasket holes 411, 412, 413, 414 and 415 that mate with fluid inputs 211, 212, 213, 214 and 215, respectively, of lower member 200. Gasket 400 further includes an open region 420 that defines the dimensions of chamber 422. Gasket 400 includes five walls 422-1, 422-2, 422-3, 422-4 and 422-5 that provide the vertical dimension of chamber 422 as depicted in FIG. 1A. Glass slide 300 provides the bottom surface of chamber 422 when the cartridge 100 is completely assembled and closed.

The output end 424 of chamber 422 is V-shaped to promote better flow of reagents through chamber 422 toward the output of the cartridge. Gasket 400 includes a plurality of check valves such as valve 430 that seat in the corresponding holes such as hole 1-4 that extend to the lower or interior major surface 500C of upper member 500. The plurality of check valves such as valve 430 prevent or limit the undesired backflow of reagents from chamber 422 back toward the fluid inputs 211-215 of cartridge 100.

Cartridge 100 includes 5 fluid channels designated 1, 2, 3, 4 and 5 that are situated extending into major surface 502 of upper member 500. It is noted that channel 4 snakes around fluid channel 5 in FIG. 1A. Fluid channel 5 does not include a check valve into the chamber because in one embodiment fluid channel 5 does not contain any cartridge reagent reservoirs. Fluid channel 5 may exclusively supply off-cartridge bulk reagents from tubes/containers plugged into a separate test instrument.

The four fluid channels designated 1, 2, 3 and 4 are input channels that are situated adjacent input end 500A of upper member 500. Upper member 500 also includes an output fluid channel 6 adjacent output end 500B. The lower or interior major surface 500C of upper member 500 provides the top surface, i.e. roof, of chamber 422 when cartridge 100 is completely assembled and closed. In one embodiment, a sealing layer 530 is situated at major surface 502 to seal the fluid channels, input holes, output holes, and reservoirs thereof within cartridge 100. In FIG. 1A, sealing layer 530 is transparent to allow viewing of the contents of the fluid channels. Sealing layer 530 may be fabricated from a thin layer of clear plastic tape material that adheres to major surface 502. In another embodiment, sealing layer 530 is not transparent and may include a label identifying the reagents packaged in the cartridge and the protocol to be used for that particular cartridge. Sealing layer 530 may also have a barcode label identifying the cartridge reagents, purpose, protocol, and manufacturing information.

A representative fluid flow through a fully assembled closed cartridge 100 containing a sample specimen is now discussed. The fully assembled closed cartridge 100 is placed in one of multiple bays in a test instrument that is discussed in more detail below. While cartridge 100 stores multiple low-volume reagents on board the cartridge itself for a particular test protocol, the test instrument provides higher volume reagents as needed for the particular test. The test instrument acts as a source of higher volume reagents that is external to the cartridge itself. These higher volume reagents may include general reagents and buffers, water, alcohol, and application(s) specific wash reagents and specimen processing reagents. The higher volume reagents are supplied via dedicated reagent port/channel on the cartridge. In actual practice, higher volume reagents pass through reagent fluid channel 5, namely the channel that includes no on board cartridge reagent reservoirs.

For example, if a particular test protocol requires a higher volume of reagent, the test instrument provides the required reagent to a representative fluid input 212 of lower member 200. While FIG. 1A is an exploded view of cartridge 100 that shows vertical dashed lines with arrows to indicate fluid flow from the input side to the output side of cartridge 100, it should be understood that before testing commences, cartridge 100 is fully assembled with glass slide 300 therein to form a sandwich-like structure such as depicted in the assembled cartridge 100 of FIG. 1B. Returning to FIG. 1A, the reagent provided to fluid input 212 flows upward through gasket hole 412, as indicated by arrow A. After passing through gasket hole 412, the reagent passes through hole 1-1 of upper member 500, as indicated by arrow B. The reagent continues flowing and flows along channel 1.

Port 1-1 is a port for an incoming lyophilized reagent rehydration water/buffer. Protocol specific lyophilized reagents (antibodies, DNA/RNA oligonucleotides or enzymes) can be located in position (i.e. reservoir) 1-2, and/or position (i.e. reservoir) 1-3, and/or position (i.e. reservoir) 1-4. In one embodiment, a lyophilized reagent can be located in position (i.e. reservoir) 1-2 and a lyophilized "blank" buffer (without reagents antibodies or DNA/RNA or enzyme), i.e. a "blocking pellet" can be "packed" in position (i.e. reservoir) 1-3, and/or position (i.e. reservoir) 1-4. In another embodiment, a lyophilized reagent can be located within the channel structure (not in a position (i.e. reservoir)) between the reservoirs and a lyophilized "blank" buffer can be "packed" in position (i.e. reservoir) 1-2 and/or 1-3 and/or 1-4. The lyophilized "blank" buffer, e.g. blocking pellet, acts as a chemically dissolvable valve protecting the lyophilized reagents from chamber back-flow or vapors from within the bay manifold or chamber. Packing of the lyophilized blank buffer makes the channel air tight and traps any vapor or moisture entering the channel thus protecting the lyophilized reagent from premature rehydration or vapor contamination prior to its use. When a channel is opened for flow, the rehydration water or buffer flows through that channel rehydrating the lyophilized "blank" buffer and lyophilized reagent and dispenses the reagent into the chamber. Each of channels 1-4 can contain a unique lyophilized reagent or the same reagent. The normally closed check valves within the chamber also isolate the channels from the chamber. When rehydration water or buffer flows through the channel, it rehydrates all lyophilized reagents in its path and pushes the check valve open into the chamber. The purpose of check valves and dissolvable channel blocks is the same, namely preventing back flow from the chamber into the channel and acting as a vapor barrier to protect the lyophilized reagent located within that channel path/reservoirs. It is possible to have an embodiment where check valves are not designed in and only blocking lyophilized pellets are utilized in reservoirs as check valves to prevent back flow from the chamber into a channel. In summary, reservoirs 1-2, 1-3 and 1-4 may include a reagent therein or a dissolvable channel block therein. In other words, a reservoir may be either a reagent reservoir or a dissolvable channel block reservoir.

A representative fluid channel 1 extends between hole 1-1 and hole 1-5, as shown. The reagent fluid flows from hole 1-1 along channel 1, by reservoir 1-2, by reservoir 1-3, by reservoir 1-4, to exit hole 1-5.

After flowing through fluid channel 1, the reagent exits hole 1-5. The reagent flows downward in the direction of gravity and pressure as indicated by arrow C. Prior to fluid flowing through channel 1, check valve 430 is closed, i.e. check valve 430 rests in a corresponding hole such as 1-4 or 1-5 to prevent backflow of fluids in chamber 422 toward the fluid inputs of cartridge 100. However, once fluid from fluid input 212 passes through channel 1 and reaches valve 430, valve 430 flexibly opens downward in the direction of gravity under the pressure of fluid flow from the input which is under pressure supplied by a pump in the test instrument described below. The reagent provided to input 212 thus reaches chamber 422 and the sample (not shown) on glass slide 300. After passing through chamber 422, the reagent and other fluids in chamber 422 will pass from V-shaped chamber end 424 up to hole 1-6 as indicated by arrow D. The fluids then travel along liquid channel 6 to hole 1-7. From hole 1-7, the fluids travel through gasket output hole 416 as indicated by arrow E. The fluids then travel from gasket hole 416 to fluid output hole 220 in lower member 200, as indicated by arrow F, at which point the fluids are exhausted from cartridge 100 for collection and proper disposal. Once the fluids are drained from the cartridge, the cartridge may be opened and the user removes the slide removed from the cartridge. The specimen on the slide may then be studied under a microscope. Such viewing under a microscope is post-processing, i.e. post-staining or post treatment by the liquid chemicals that were in chamber 422.

Figure 1B:
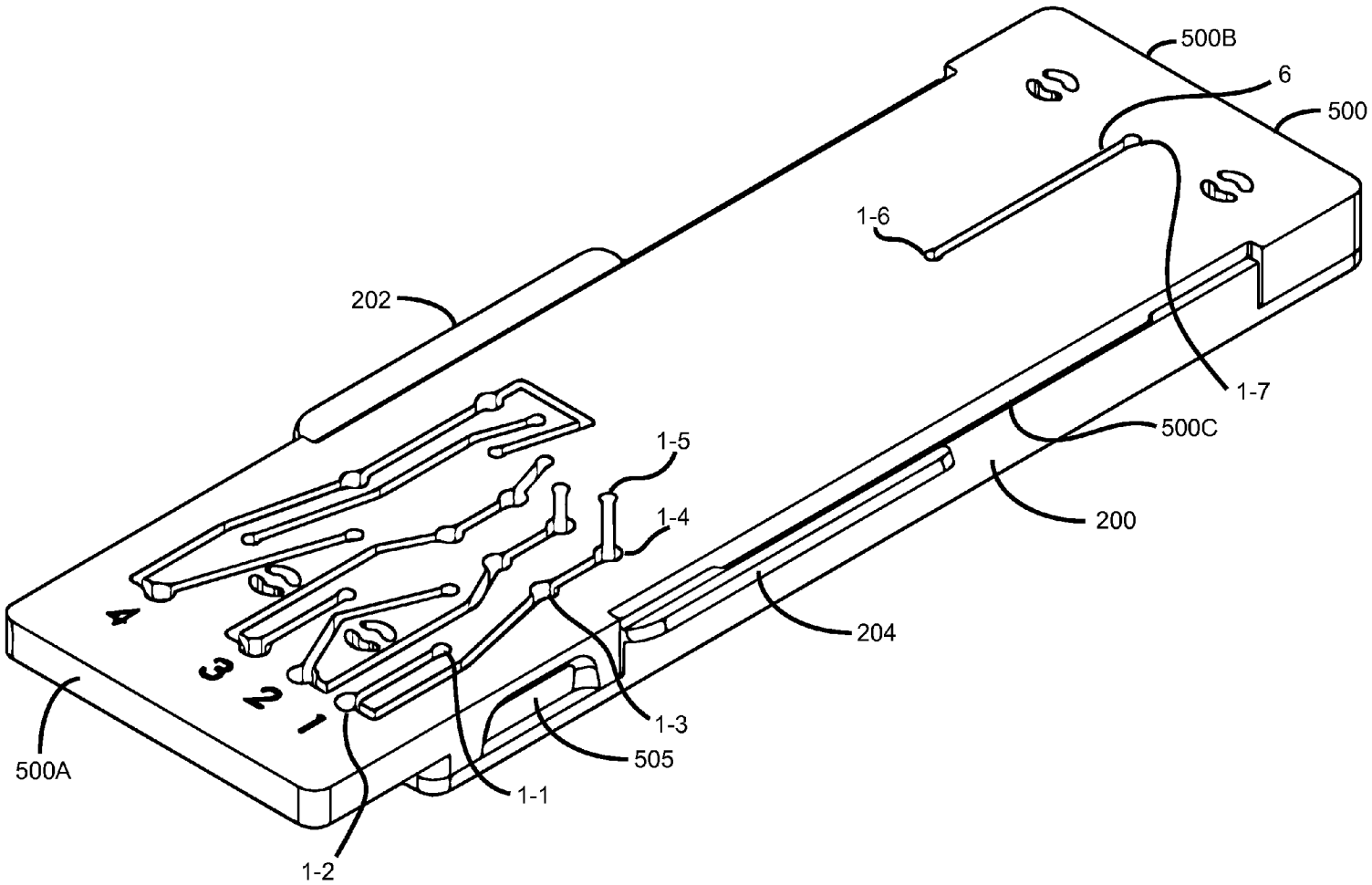
FIG. 1B is a top perspective view of one embodiment of the disclosed sample processing cartridge.

FIG. 1B is a top perspective view of the assembled cartridge 100 with the glass specimen slide 300 installed inside. Like numbers indicate like elements when comparing cartridge 100 of FIG. 1B with cartridge 100 of FIG. 1A. FIG. 1B shows that upper member 500 includes an indentation 505 adjacent wing-like tab 204 of lower member 200. Indentation 505 cooperates with wing-like tab 204 to make it easier for the user to grasp cartridge 100. Upper member 500 also includes another indentation 510 (not shown in this view) adjacent wing-like tab 202 on the opposed side of upper member 500 for the same purpose. In one embodiment, upper member 500 includes a ledge adjacent end 500A that overhangs lower member 200 below.

Figure 1C:
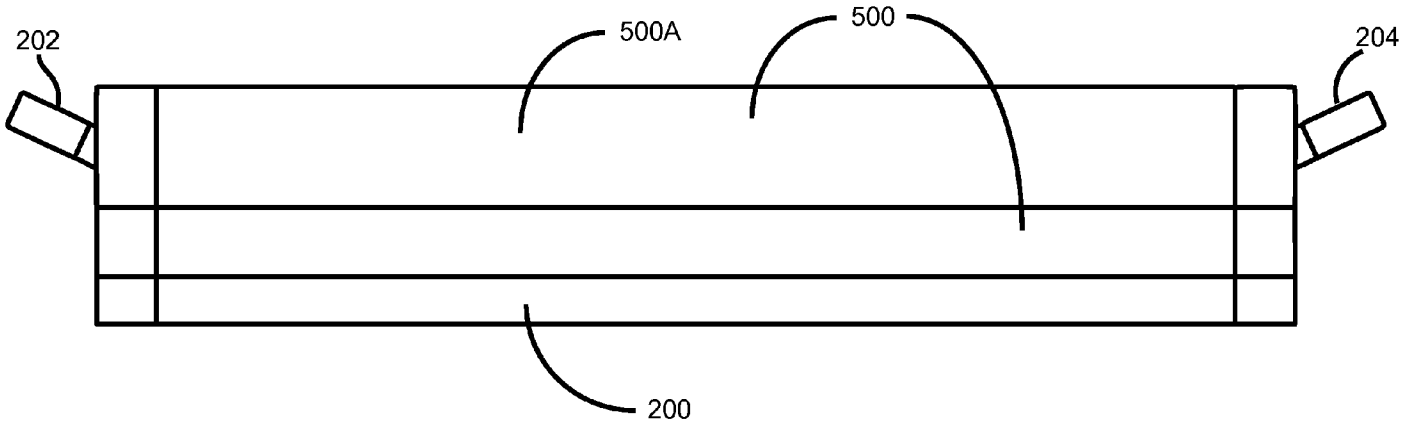
FIG. 1C is a plan view of one end of the disclosed sample processing cartridge.
Figure 1D:
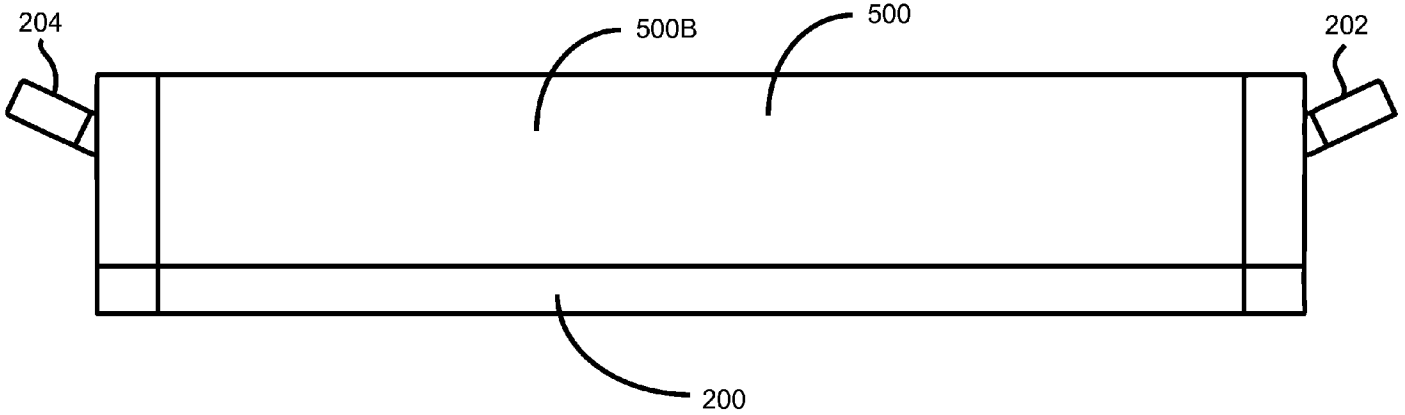
FIG. 1D is a plan view of an opposite end of the disclosed sample processing cartridge.

FIG. 1C is a front side plan view of cartridge 100 including upper member 500 and lower member 200, and showing wing-like table 202 and 204. FIG. 1C is viewed facing upper member end 500A. FIG. 1D is a rear side plan view of cartridge 500 including upper member 500 and lower member 200, and showing wing-like table 202 and 204. FIG. 1D is viewed facing upper member end 500B.

Figure 1E:
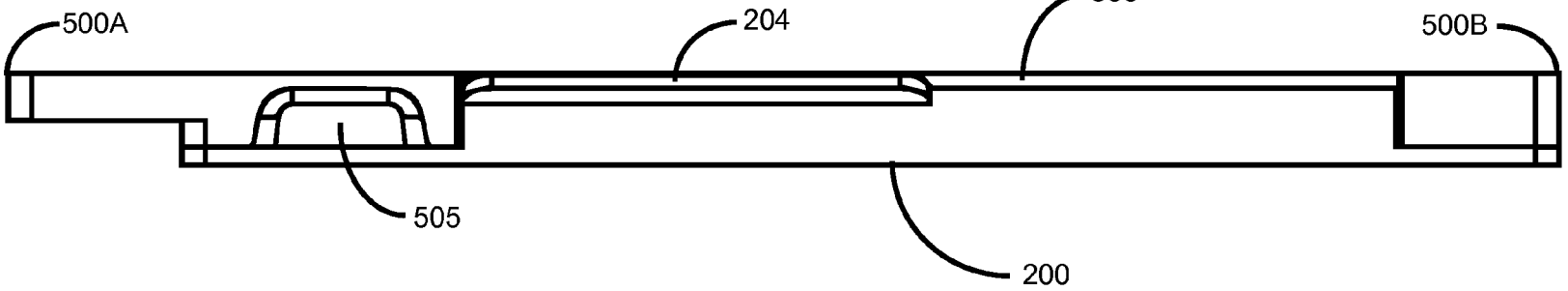
FIG. 1E is a plan view of one side of the disclosed sample processing cartridge.
Figure 1F:
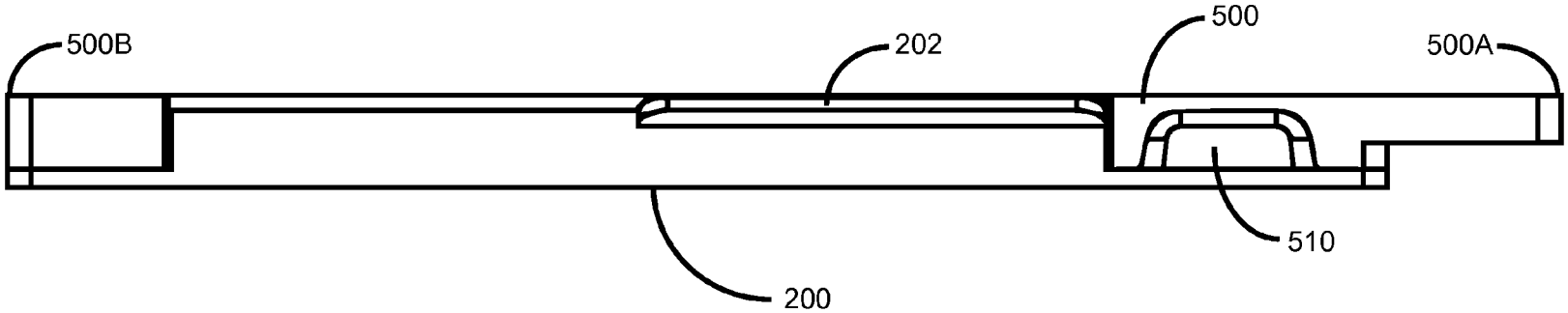
FIG. 1F is a plan view an opposite side of the disclosed sample processing cartridge.

After flowing through fluid channel 1, the reagent exits hole 1-5. The FIG. 1E is a right side plan view of cartridge 500 including upper member 500 and lower member 200, and showing wing-like tab 204. FIG. 1E is viewed facing tab 204 FIG. 1F is a left side plan view of cartridge 500 including upper member 500 and lower member 200, and showing wing-like tab 202. FIG. 1F is viewed facing tab 202.

Figure 1G:
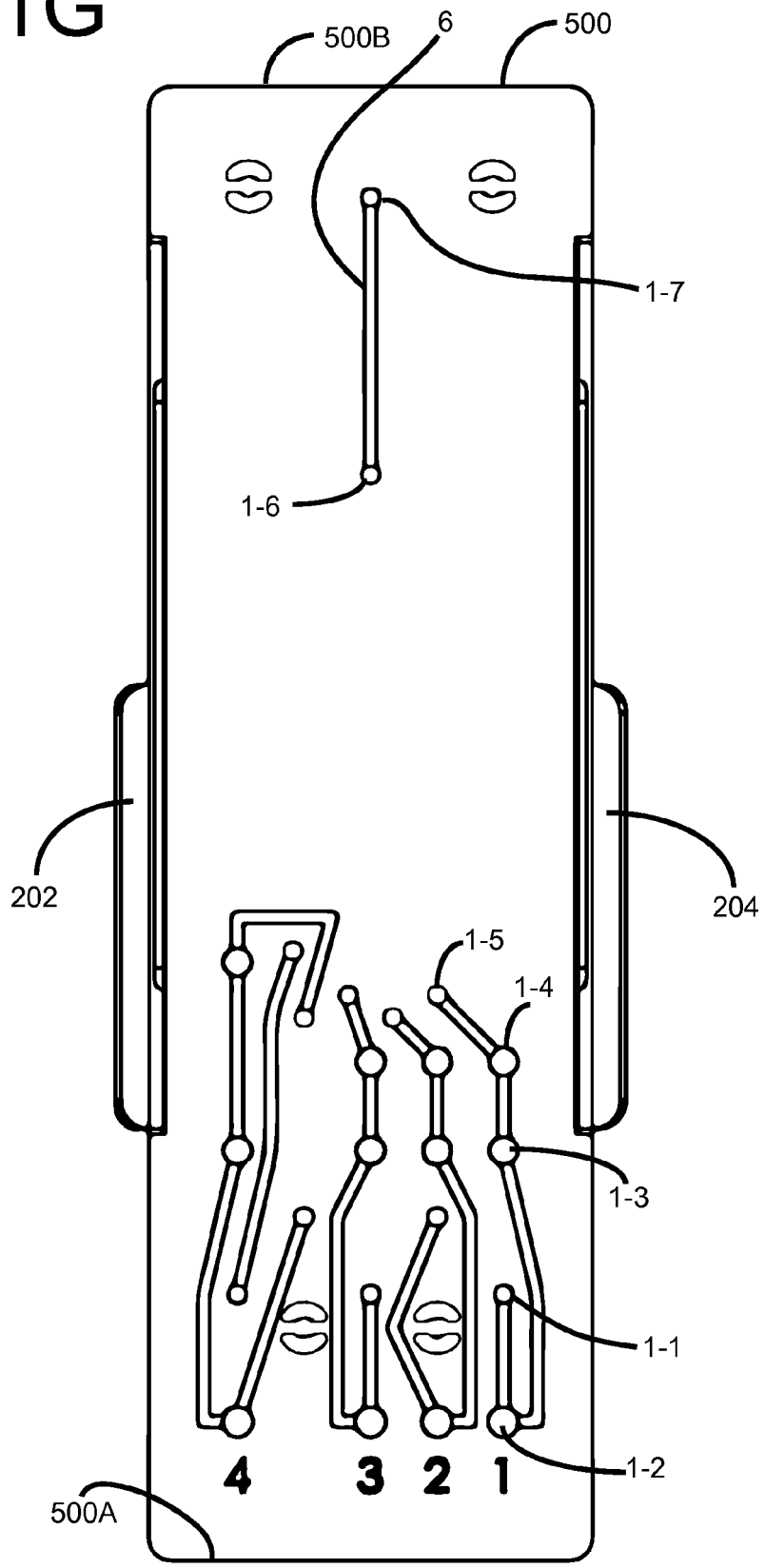
FIG. 1G is a top plan view of one embodiment of the disclosed sample processing cartridge.

FIG. 1G is a top plan view of cartridge 100 showing the upper member 500 of cartridge 100. When comparing the view of FIG. 1G with cartridge 100 of FIG. 1B, like numbers indicate like elements.

Figure 1H:
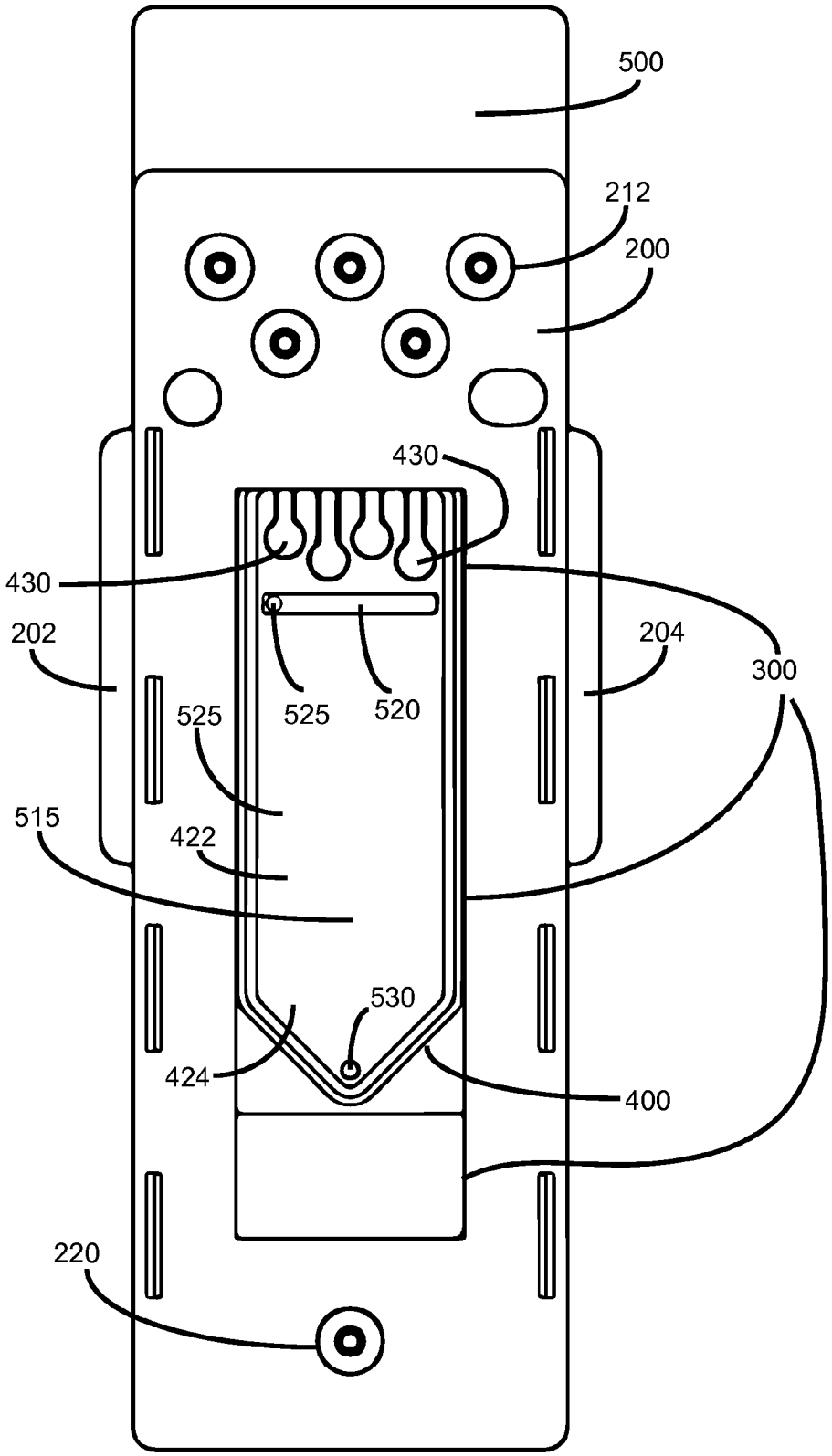
FIG. 1H is a bottom view of one embodiment of the disclosed sample processing cartridge showing a specimen slide forming one surface of the chamber thereof.

FIG. 1H shows a bottom plan view of cartridge 100. The view of FIG. 1H shows upper member 500, lower member 200, multiple fluid inputs such as fluid input 212. Upper member 500 includes a roof 515 with a fluid channel 520 therein. Fluid channel 520 includes a channel opening 525 that fluidically couples to one of the remaining fluid inputs of upper member 500 other than fluidic input 212. In this way a fluid such as a reagent or water is supplied to chamber 422 in a quantity and/or concentration appropriate four a particular test protocol. Chamber output end 424 is V-shaped and corresponds to the V-shape of the gasket 400 end adjacent an output hole 530 in roof 515 of upper member 500. Output hole 530 fluidically couples to fluid output 220 of lower member 200 via fluid channel 6 which is visible in FIG. 1B.

Figure 1I:
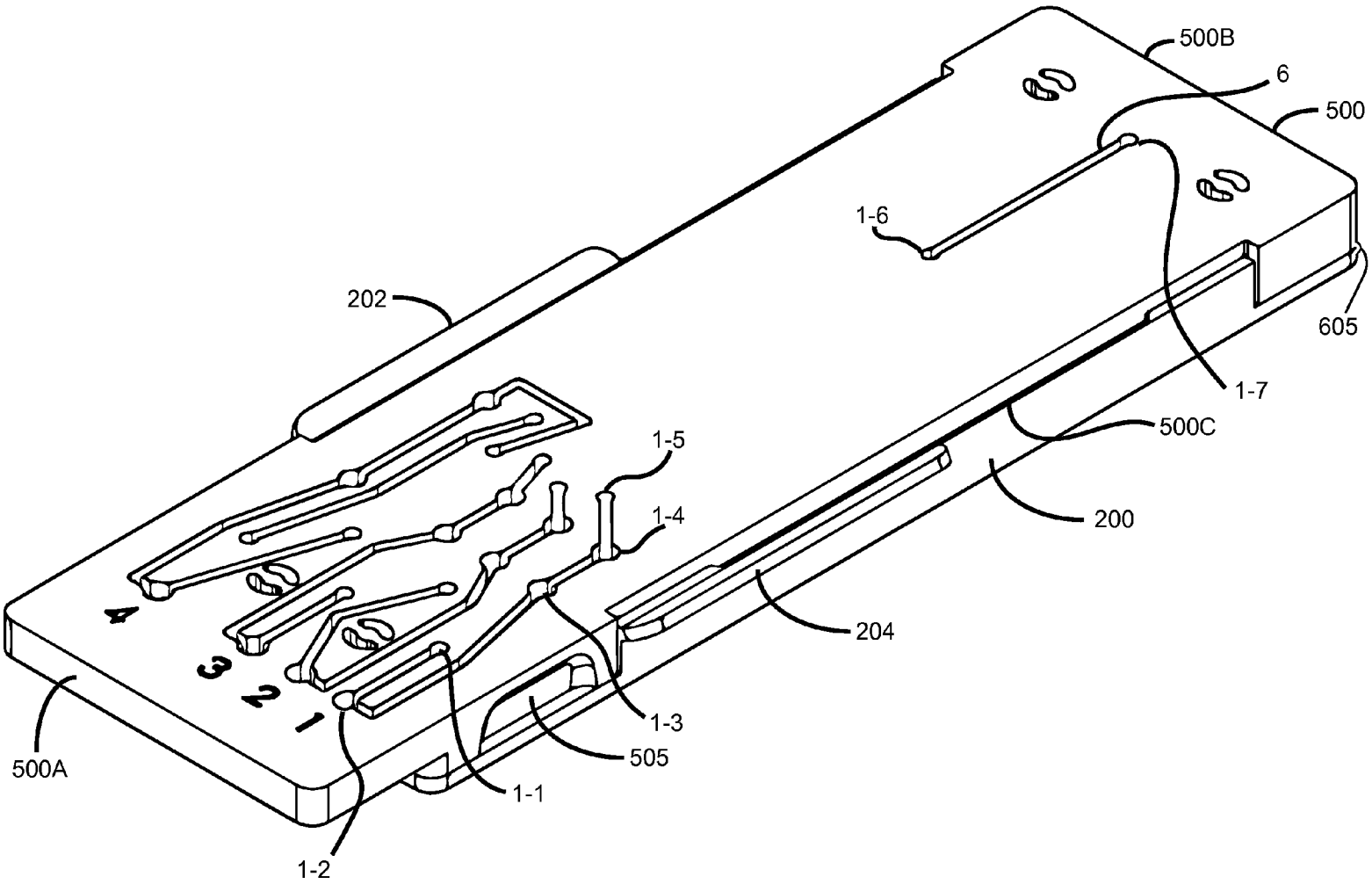
FIG. 1I is a top perspective view of one embodiment of the disclosed sample processing cartridge showing a hinge connecting the different portions of the cartridge together.

FIG. 1I is a perspective view of an alternative embodiment cartridge, nameyl cartridge 100' that is configured similarly to cartridge 100 of FIG. 1B, except that cartridge 100' includes a hinge 605 that connects upper member 500 to lower member 200 at the output end of the cartridge. In one embodiment, hinge 605 is a living hinge that is integrally formed of the same polycarbonate, plastic, or similar material that forms upper member 500 and lower member 200.

In one embodiment, cartridge 100 may include multiple interior alignment pins and corresponding holes that assist in aligning, mating and closing upper member 502 to lower member 200.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A self-contained sample processing cartridge, comprising:

a first cartridge portion including a receiver that receives a specimen slide, the receiver including a receiver open region that the specimen slide covers when the specimen slide is situated in the receiver, the first cartridge portion including a plurality of fluid inputs that are configured to receive externally supplied liquids, the first cartridge portion further including at least one fluid output; and a second cartridge portion that closes on the first cartridge portion to form a chamber interior to the cartridge, wherein the specimen slide covers the receiver open region of the slide receiver of the first cartridge portion to form both an interior surface of the chamber and an exterior surface of the first cartridge portion, the second cartridge portion including first and second opposed major surfaces of which the first opposed major surface is oriented facing away from the chamber and the second opposed major surface is oriented facing the chamber;

wherein the second cartridge portion includes a plurality of channels situated extending into the first opposed major surface thereof that faces away from the chamber, the plurality of channels being configured to couple the fluid inputs of the first cartridge portion to the chamber, wherein the second cartridge portion further includes at least one output channel that couples to the at least one fluid output of the first cartridge portion;

wherein at least one of the plurality of channels includes a reagent reservoir configured to provide a preloaded reagent to the chamber.

2. The self-contained sample processing cartridge of claim 1, wherein at least one of the plurality of channels is dedicated to externally supplied reagents.

3. The self-contained sample processing cartridge of claim 1, wherein the at least one of the plurality of channels that includes a reagent reservoir also includes a dissolvable channel block reservoir.

4. The self-contained sample processing cartridge of claim 1, wherein the externally supplied liquid is a reagent.

5. The self-contained sample processing cartridge of claim 1, further comprising a gasket seal between the first and second cartridge portions, the gasket seal including a gasket open region that provides side walls of to the chamber, such that the gasket seal provides a vertical dimension of the chamber.

6. The self-contained sample processing cartridge of claim 1, further comprising respective fluid flow control check valves for the plurality of fluid channels, the control check valves being configured to prevent back-flow from the chamber to the plurality of fluid inputs.

7. The self-contained sample processing cartridge of claim 5, wherein the gasket seal includes respective integral fluid flow control check valves for the plurality of fluid channels, each fluid control check valve being assigned a different channel of the plurality of channels.

8. The self-contained sample processing cartridge of claim 1, wherein the plurality of channels of the second cartridge portion extend adjacent an exterior surface of the second cartridge portion, the self-contained sample processing cartridge further comprising a transparent sealing layer covering the plurality of channels of the second cartridge portion, such that the interiors of the plurality of channels are visible exterior to the cartridge.

9. The self-contained sample processing cartridge of claim 5, wherein the chamber includes an input end and an output end, wherein two side walls of the gasket seal together form a V-shape at the output end of the chamber.

10. The self-contained sample processing cartridge of claim 1, further comprising a hinge that couples the first cartridge portion to the second cartridge portion at a common end thereof.

11. The self-contained sample processing cartridge of claim 1, wherein the slide receiver includes a retaining ledge on which the specimen slide rests to form a bottom of the chamber.

* * * * *